US005885441A

United States Patent [19]

Pereira et al.

[11] Patent Number: 5,885,441

[45] **Date of Patent: *Mar. 23, 1999**

[54] STEAM CONVERSION PROCESS AND CATALYST

[75] Inventors: Pedro Pereira; Roger Marzin; Luis Zacarias, all of Edo. Miranda; José Córdova, Caracas; José Carrazza, Edo. Miranda; Marian Mariño, Caracas, all of Venezuela

[73] Assignee: Intevep, S.A., Caracas, Venezuela

[ * ] Notice: The term of this patent shall not extend beyond the expiration date of Pat. No. 5,688,395.

[21] Appl. No.: 838,834

[22] Filed: Apr. 11, 1997

[51] Int. Cl.[6] ..... C10G 13/02

[52] U.S. Cl. ..... 208/130; 208/121; 208/124; 208/153; 502/344; 502/326

[58] Field of Search ..... 208/34.01, 130, 208/121, 153; 502/344, 326

[56] References Cited

U.S. PATENT DOCUMENTS

| | | | |
|---|---|---|---|
| 3,676,331 | 7/1972 | Pitchford | 208/112 |
| 4,743,357 | 5/1988 | Patel et al. | 208/113 |
| 5,688,395 | 11/1997 | Carrazza et al. | 208/130 |
| 5,688,741 | 11/1997 | Carrazza et al. | 502/344 |

FOREIGN PATENT DOCUMENTS

| | | |
|---|---|---|
| 612327 | 10/1926 | France . |

*Primary Examiner*—Helane Myers
*Attorney, Agent, or Firm*—Bachman & LaPointe, P.C.

[57] ABSTRACT

A process for steam conversion of a hydrocarbon feedstock in the presence of a catalyst includes the steps of (a) providing a catalytic emulsion comprising a water in oil emulsion containing a first alkali metal and a second metal selected from the group consisting of Group VIII non-noble metals, alkaline earth metals and mixtures thereof; (b) mixing the catalytic emulsion with a hydrocarbon feedstock to provide a reaction mixture; and (c) subjecting the reaction mixture to steam conversion conditions so as to provide an upgraded hydrocarbon product. A catalytic emulsion and process for preparing same are also provided.

59 Claims, 3 Drawing Sheets

STEAM CONVERSION PROCESS AND CATALYST

BACKGROUND OF THE INVENTION

The invention relates to a steam conversion process and a catalyst for providing a high rate of conversion of a heavy hydrocarbon feedstock to lighter more valuable hydrocarbon products as well as a process for preparing the catalyst.

Various processes are known for converting heavy hydrocarbons into more desirable liquid and gas products. These processes include visbreaking and extreme thermal cracking. However these processes are characterized by low conversion rates and/or a large percentage of undesirable by-products such as coke which, among other things, can pose transportation and disposal problems.

It is therefore the primary object of the present invention to provide a steam conversion process wherein good conversion is obtained with reduced levels of undesirable by-products such as coke.

It is a further object of the present invention to provide a steam conversion catalyst useful for carrying out the process of the present invention.

It is a still further object of the present invention to provide a process for preparing the steam conversion catalyst of the present invention.

It is another object of the present invention to provide a process for recovering catalyst metals from by-products of the steam conversion process for use in preparation of catalyst for subsequent steam conversion processes.

Other objects and advantages of the present invention will appear hereinbelow.

SUMMARY OF THE INVENTION

In accordance with the invention, the foregoing objects and advantages are readily attained.

According to the invention, a process for the steam conversion of a hydrocarbon feedstock in the presence of a catalyst is provided, which process comprises the steps of (a) providing a catalytic emulsion comprising a water in oil emulsion containing a first alkali metal and a second metal selected from the group consisting of Group VIII non-noble metals, alkaline earth metals and mixtures thereof; (b) mixing the catalytic emulsion with a hydrocarbon feedstock to provide a reaction mixture; and (c) subjecting the reaction mixture to steam conversion conditions so as to provide an upgraded hydrocarbon product.

Further according to the invention, the process for steam conversion preferably comprises the steps of providing an acidic hydrocarbon stream having an acid number of at least about 0.4 mg KOH/g of hydrocarbon; providing a first solution of said first alkali metal in water; mixing the acidic hydrocarbon stream and the first solution so as to at least partially neutralize said hydrocarbon stream and form a substantially homogeneous mixture wherein said alkali metal reacts with said hydrocarbon stream to form an alkali organic salt; providing a second solution of said second metal in water; and mixing the substantially homogeneous mixture and the second solution to provide said catalytic emulsion.

A catalytic emulsion for steam conversion of a hydrocarbon feedstock is also provided according to the invention which comprises a water in oil emulsion containing a first alkali metal and a second metal selected from the group consisting of Group VIII non-noble metals, alkaline earth metals and mixtures thereof.

A process for preparing the subject catalytic emulsion is provided which comprises the steps of providing an acidic hydrocarbon stream having an acid number of at least about 0.4 mg KOH/g of hydrocarbon; providing a first solution of said first alkali metal in water; mixing the acidic hydrocarbon stream and the first solution so as to at least partially neutralize said hydrocarbon stream and form a substantially homogeneous mixture wherein said alkali metal reacts with said hydrocarbon stream to form an alkali organic salt; providing a second solution of said second metal in water; and mixing the substantially homogeneous mixture and the second solution to provide said catalytic emulsion.

BRIEF DESCRIPTION OF THE DRAWINGS

A detailed description of preferred embodiments of the invention follows, with reference to the attached drawings, wherein.

DETAILED DESCRIPTION

Figure 1:
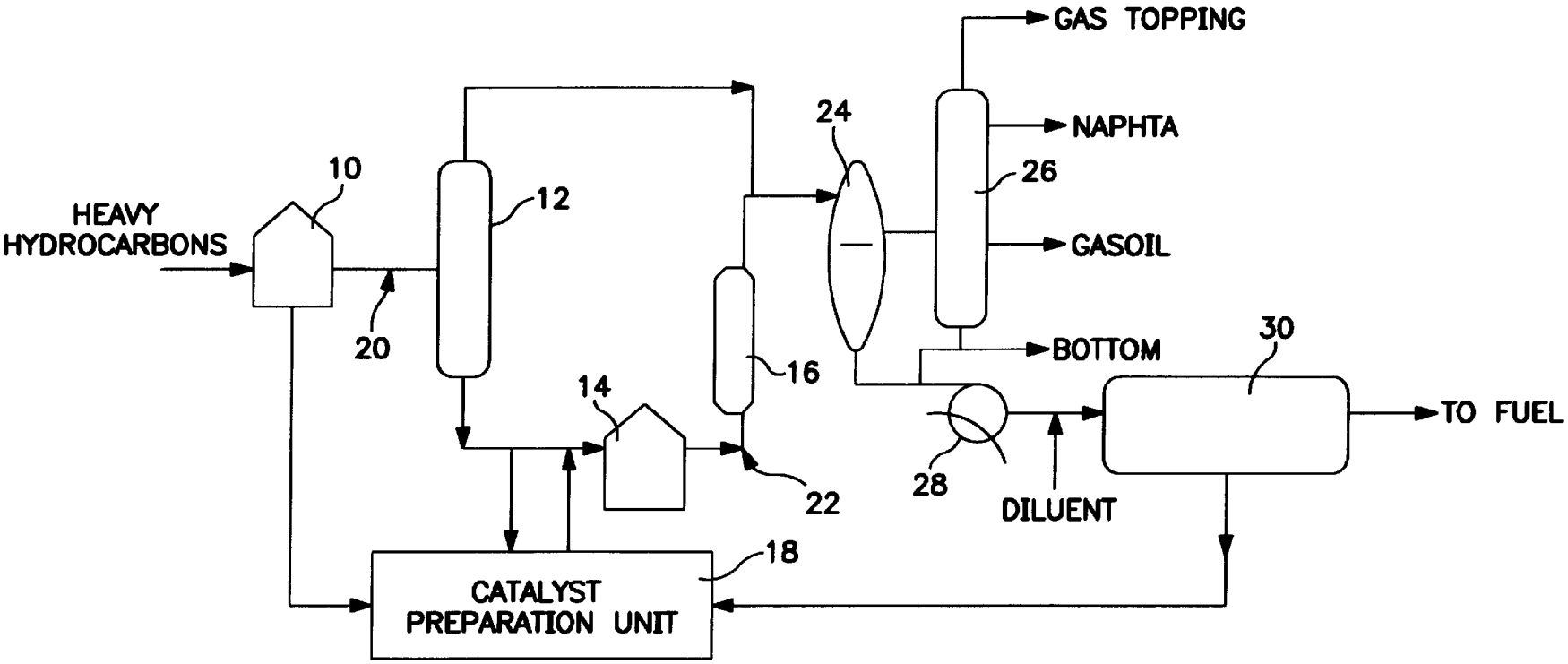
FIG. 1 is a schematic representation of a steam conversion process in accordance with the present invention.

The invention relates to a steam conversion process and catalyst for use in upgrading a heavy hydrocarbon feedstock such as an extra heavy crude or feedstock including a residue fraction having a boiling point greater than 500° C., and to a process for preparing the catalyst.

In accordance with the invention, a steam conversion process and catalyst are provided which advantageously enhance conversion of such heavy hydrocarbon feedstock as compared to conversion obtained using conventional visbreaking or thermal cracking procedures, and further which provide a lower production rate of undesirable solid by-products such as coke.

The feedstock to be treated in accordance with the present invention may be any suitable heavy hydrocarbon feedstock wherein conversion to lighter more valuable products is desired. The feedstock may, for example, be a feedstock including a residue fraction having a boiling point greater than 500° C. or having a significant portion having a boiling point greater than 500° C. and an additional portion having a boiling point in the 350°–500° C. range, or may be substantially the residue fraction itself, for example after fractionating of a particular initial feedstock, or could be a vacuum residue or any other suitable feed. Table 1 set forth below contains characteristics of a typical example of a suitable feedstock for treatment in accordance with the invention.

TABLE 1

| Vacuum Residue Characterization | Content |
|---|---|
| Carbon (% wt) | 84.3 |
| Hydrogen (% wt) | 10.6 |
| Sulfur (% wt) | 2.8 |
| Nitrogen (% wt) | 0.52 |
| Metals (ppm) | 636 |
| API Gravity | 6 |
| Asphaltenes (% wt) | 11 |
| Conradson Carbon (% wt) | 18.6 |

TABLE 1-continued

| Vacuum Residue Characterization | Content |
|---|---|
| 500° C.+ (% wt) | 95 |
| Viscosity (210° F., cst) | 2940 |

A vacuum residue as characterized in Table 1 is an example of a suitable feedstock which can advantageously be treated in accordance with the present invention. Of course, numerous other feeds could be treated as well.

In accordance with the invention, a steam conversion process is provided for upgrading a heavy hydrocarbon feedstock such as that of Table 1 so as to upgrade the hydrocarbon feedstock to provide lighter, more valuable products. According to the invention, the feedstock is contacted, under steam conversion conditions, with a catalyst according to the invention in the form of a catalytic water in oil emulsion containing a first alkali metal and a second metal selected from Group-VIII non-noble metals, alkaline earth metals, and mixtures thereof, whereby the heavy hydrocarbon feedstock is upgraded.

Steam conversion conditions according to the invention include a temperature of between about 360° C. to about 520° C., preferably between about 410° C. to about 470° C.; a pressure of less than or equal to about 600 psi, and preferably between about 5 psi to about 600 psi, ideally less than or equal to about 300 psi and preferably between about 10 psi to about 300 psi; a liquid hourly space velocity of between about 0.001 $h^{-1}$ to about 3.5 $h^{-1}$ depending upon the desired severity of treatment; and steam in an amount between about 1% to about 15% wt., preferably between about 3% to about 12% wt. based upon the feed.

Depending upon the feedstock to be treated, process pressure may suitably be substantially atmospheric, or may be somewhat higher, for example between about 50 psi to about 600 psi, preferably between about 100 psi to about 300 psi.

Steam conversion conditions are advantageous as compared to conventional conversion with hydrogen because lower pressures can be used than would be needed to maintain hydrogen. Thus, the steam conversion process of the present invention allows for reduction in cost of equipment and the like for operating at elevated pressures.

The catalyst or catalytic emulsion according to the present invention is preferably provided in the form of a water-in-oil emulsion, preferably having an average droplet size of less than or equal to about 10 microns, more preferably less than or equal to about 5 microns, and having a ratio of water to oil by volume of between about 0.1 to about 0.4, more preferably between about 0.15 to about 0.3. According to the invention, the catalytic emulsion is provided so as to include a first alkali metal, preferably potassium, sodium or mixtures thereof, and a second metal which may preferably be a Group VIII non-noble metal, preferably nickel or cobalt, or an alkaline earth metal, preferably calcium or magnesium, or mixtures thereof. The catalytic emulsion may suitably contain various combinations of the above first and second metals, and particularly preferred combinations include potassium and nickel; sodium and nickel; sodium and calcium; and sodium, calcium and nickel. The catalytic emulsion preferably contains the first alkali metal at a concentration of at least about 10,000 ppm based upon the catalytic emulsion, and also preferably contains first alkali metal and second metal at a ratio by weight of between about 0.5:1 to about 20:1, more preferably between about 1:1 to about 10:1.

In accordance with the invention, the catalytic emulsion is preferably prepared by providing an acidic hydrocarbon stream, preferably having an acid number of at least about 0.5 mg KOH/g of hydrocarbon, wherein the acid number is defined by ASTMD 664-89. The acid number, as set forth in ASTMD 664-89, is the quantity of base, expressed in milligrams of potassium hydroxide per gram of sample, required to titrate a sample in the solvent from its initial meter reading to a meter reading corresponding to a freshly prepared non-aqueous basic buffer solution. In the present invention, this number is used to refer to the quantity of base required to neutralize the acidity of the acidic hydrocarbon stream being used to prepare the catalytic emulsion of the present invention.

To the acidic hydrocarbon stream, water solutions of the desired catalyst metals are added as follows to prepare the desired catalytic emulsion.

A solution of the first alkali metal in water is provided for mixing with the acidic hydrocarbon stream. According to the invention, the solution of alkali metal in water is preferably a saturated solution containing alkali metal within about 5% of the saturation point of the solution at ambient temperature, wherein the saturation point is the point beyond which additional alkali metal would not dissolve in solution and would, instead, precipitate from the solution. More dilute solutions could be used, however, the volume of water added ends up as part of the catalytic emulsion and eventually must be vaporized during treatment of the feedstock. It is therefore preferred to provide the solution as indicated above within about 5% of the saturation point so as to avoid unnecessary heating demands.

According to the invention, the acidic hydrocarbon stream and solution of alkali metal in water are combined and mixed so as to at least partially neutralize the hydrocarbon stream and form a substantially homogeneous mixture wherein the alkali metal reacts with the hydrocarbon stream to provide an alkali organic salt, and preferably reacts with naphthenic acid contained in the hydrocarbon stream to provide an alkali naphthenic salt. This step can be carried out entirely within a mixer, if desired, or the streams may be combined upstream of a mixer and fed to the mixer for suitable mixing to provide the desired substantially homogeneous mixture, which may at this point be an emulsion. The hydrocarbon stream and amount of alkali metal are preferably selected such that substantially all alkali metal reacts to form alkali organic salt, preferably alkali naphthenic salt, while at least partially and preferably substantially neutralizing acidity of the hydrocarbon stream. This helps to insure the substantially homogeneous incorporation of the alkali metal into the end catalyst emulsion.

Conversion of alkali metal to alkali organic salt is desirable because alkali still in hydroxide form in the mixture could react with second metal salts during later mixing to provide undesirable second metal oxides such as nickel oxide which adversely affect the overall process. Further, remaining high acidity is, in most cases, undesirable as corrosive to mixing equipment and the like.

A second solution is provided of the second metal, Group VIII non-noble metal, alkaline earth metal or a mixture of both, in water. The second solution is also preferably a saturated solution, most preferably containing suitable second metal in an amount within about 5%, more preferably within about 2% of the saturation point of the second solution. The second metal is preferably provided in the second solution in the form of an acetate, such as nickel acetate, for example.

The second solution is then combined and mixed with the substantially homogeneous mixture of the first solution and acidic stream as described above. The second solution and substantially homogeneous mixture may be combined in a mixing apparatus for carrying out the mixing step, or upstream of the mixing apparatus, as desired in accordance with the parameters of a specific process.

This second mixing step wherein the second solution is mixed with the substantially homogeneous mixture provides the catalytic emulsion as described above, wherein the first alkali metal in the form of alkali naphthenic salt is located in the interface between water droplets and the continuous oil phase and acts as a surfactant, and wherein the second metal remains dissolved in the water droplets of the emulsion.

It should be noted that the mixing steps as set forth above are carried out using equipment which is well known in the art and which forms no part of the present invention.

In accordance with the invention, the acidic hydrocarbon stream from which the catalytic emulsion is prepared preferably has an acid number of between about 0.4 mg KOH/g to about 300 mg KOH/g. This stream can be obtained from the heavy hydrocarbon feedstock to be treated, if the feedstock is suitably acidic. Alternatively, the acidic hydrocarbon stream can be provided from any other suitable source. It is preferred that the acidic hydrocarbon stream contain an organic acid, preferably naphthenic acid, which has been found to advantageously react with alkali metal during preparation of the catalytic emulsion so as to provide the desired alkali naphthenic salt which advantageously acts as a surfactant to provide additional stability and desired droplet size for the catalytic emulsion of the present invention.

During the mixing steps, the alkali naphthenic salt migrates to the interface between water droplets and the oil continuous phase of the catalytic emulsion and acts as a surfactant to assist in maintaining the stability of the emulsion, and helps to insure a sufficiently small droplet size which provides for good dispersion of the second metal in the feedstock.

Use of the catalytic emulsion containing the catalytic first and second metals advantageously serves to enhance the rapid distribution of the catalytic metals throughout a feedstock being upgraded according to the process of the present invention so as to greatly improve conversion of the heavy residue fraction or other feedstock. When the catalytic emulsion and feedstock are mixed, the catalytic metals are substantially dispersed throughout the feedstock and it is believed that steam conversion conditions then serve to vaporize water from the emulsion to provide at least some of the steam requirements for the process and also to result in a very fine particulate, partly solid and partly melted, of the first and second catalytic metals in close contact with the feedstock thereby enhancing the desired conversion to lighter products.

Furthermore, the steam conversion process of the present invention results, under conditions of increased severity, in provision of an upgraded hydrocarbon product, and also a residue or coke by-product which, while being of a greatly reduced amount as compared to conventional processes, has also been found to contain the spent first and second catalytic metals. The by-product is either residue or coke or both depending upon severity of the process. In accordance with the process of the present invention, the coke or residue by-product is preferably further treated, for example through desalinization for residue or gasification for coke, to recover the catalytic metals for subsequent use in preparing catalytic emulsion for continuing steam conversion processes. Such procedures have been found to recover a large amount of the alkali metal when residue is desalted and, in some cases, to provide a recovery of greater than 100% of the second metal, especially Group VIII non-noble metal, when gasification of the carbonaceous solid (coke) by-product is performed along with a high yield of recovery of alkali metal. When the by-product is mainly residue, it can be desalted for metal recovery by dilution for example up to about 14° API and then transported for conventional desalinization.

In a typical process in accordance with the invention, a heavy hydrocarbon feed is passed through a furnace for providing a desired temperature, and then to a fractionator for separating out various fractions to provide the heavy hydrocarbon residue feedstock which is to be treated in accordance with the present invention.

If the by-product of the process is rich in solid (i.e., coke greater than or equal to about 5%), the residue can be gasified or controlled combusted, and the resulting ash can be washed to recover alkali metal by water dissolution while any remaining solid can be treated in the presence of $CO_2$ and ammonia to produce $NiCO_3$, which can be converted into nickel acetate using acetic acid at room temperature. This of course is for the case where the second metal is nickel. Further, recovery of higher than 100% of the spent nickel can be obtained using this method since some nickel indigenous to the feed is recovered above and beyond the process nickel used in forming the catalytic emulsion.

Referring now to the drawings, FIG. 1 schematically illustrates an example of a system for carrying out the steam conversion process of the present invention.

Referring to FIG. 1, heavy hydrocarbon feedstock to be treated is fed to a furnace 10 for heating to a suitable temperature, and then to an atmospheric or vacuum fractionator 12 for separating off light components. Heavier components from fractionator 12 are fed toward another furnace 14 for further heating, and subsequently to a soaker/reactor 16 for carrying out the conversion process. As shown in FIG. 1, a catalyst preparation unit or station 18 is provided wherein the catalytic emulsion of the present invention is prepared. This catalytic emulsion can be mixed with the feedstock to be converted at a number of different locations. FIG. 1 shows the catalytic emulsion being injected to the feedstock after fractionator 12 and before furnace 14. Alternatively, catalytic emulsion could be mixed with the hydrocarbon feedstock after furnace 10 and before fractionator 12, as indicated by point 20, or could be introduced after furnace 14 and before soaker/reactor 16 as shown at point 22.

Still referring to FIG. 1, the product of soaker/reactor 16 is recombined with light products from fractionator 12, and fed to cyclone stripper 24 wherein upgraded hydrocarbon products are separated from by-products. The upgraded product is fed to fractionator 26 where the upgraded product is separated into various fractions including a gas topping, naphtha, gasoil and bottoms, while by-product is fed through a heat exchanger 28 to a desalting unit 30 for additional processing as desired. Diluent may be added to this fraction, as shown in the drawing, as desired.

At desalting unit 30, catalytic metals are recovered from the by-products, and are preferably returned to catalyst preparation unit 18 for use in preparing additional catalytic emulsion for use in the process of the present invention, with additional or make-up metals being added as needed. Further, and also shown in FIG. 1, a portion of feedstock from furnace 10 may be diverted to catalyst preparation unit 18, if desired for use as the acidic hydrocarbon stream from which the catalytic emulsion is prepared. This is particularly preferable if the hydrocarbon feedstock to be treated has sufficient acidity or other surfactant content.

It should of course be noted that although a schematic representation of a system for carrying out the conversion process of the present invention is shown in FIG. 1, the process could of course be carried out using different steps and different equipment, and no limitation upon the scope of the present invention is intended.

Figure 2:
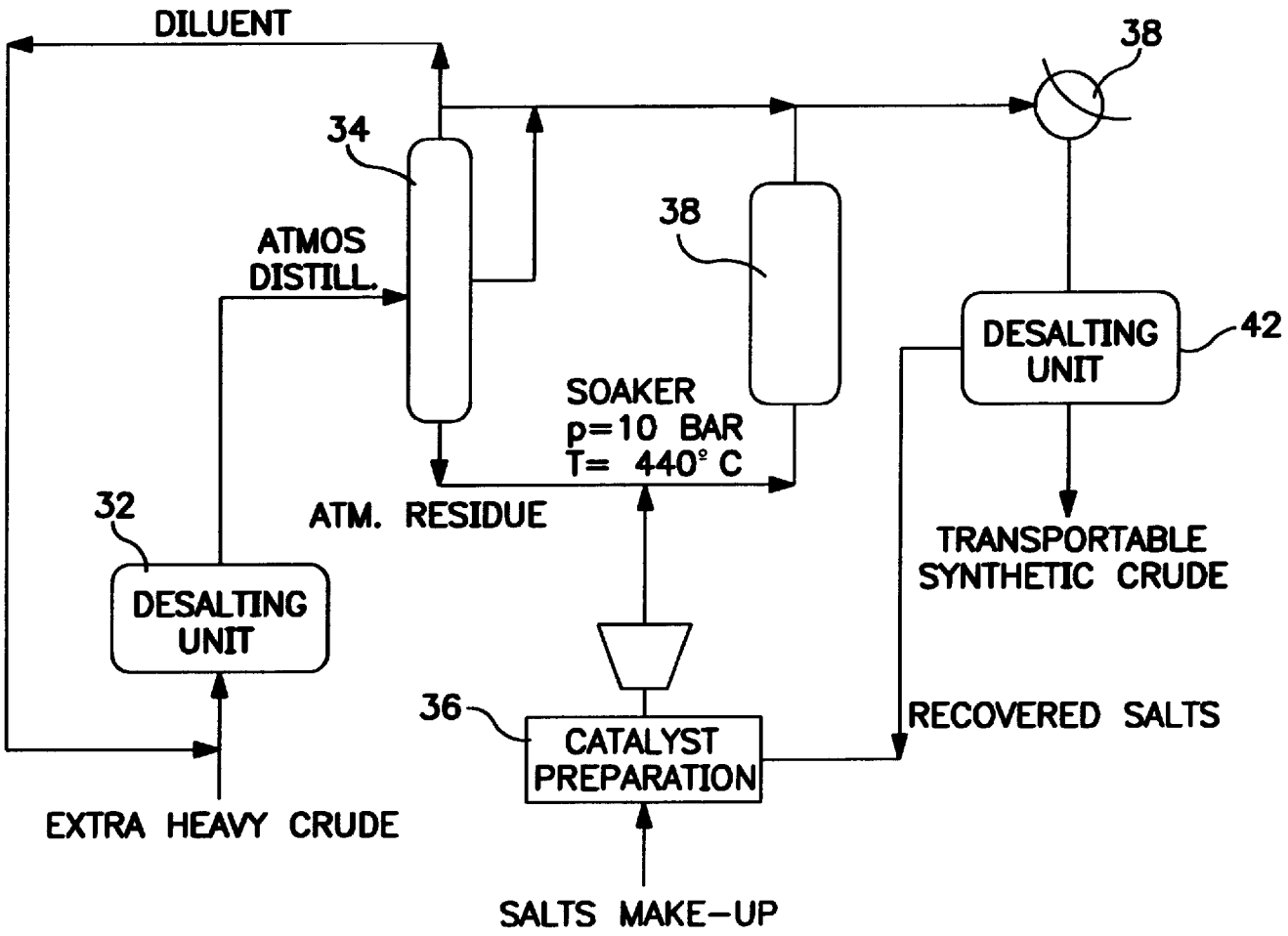
FIG. 2 is a schematic representation of a process for production of a synthetic crude oil in accordance with the present invention.

Referring now to FIG. 2, an alternate schematic representation of a process in accordance with the present invention is illustrated in connection with a process for producing synthetic crude oil from extra heavy crude oil.

Referring to FIG. 2, an extra heavy crude feedstock typically having a low API gravity, for example less than or equal to about 10°, may suitably be mixed with a diluent to increase the API gravity, for example to about 14°, so as to allow treatment of the feedstock at a conventional desalting unit 32. From desalting unit 32, the desalted feed may suitably be fed to an atmospheric distillation unit 34, wherein diluent for subsequent feedstock dilution is separated, as are other lighter products and an atmospheric residue. The atmospheric residue is preferably mixed with catalytic emulsion according to the invention from a catalyst preparation station 36, and fed to a soaker/reactor 38 for carrying out the conversion of the present invention. As shown, the mixture of feedstock and catalytic emulsion is exposed in soaker/reactor 38 to steam conversion conditions, for example a pressure of 10 barg and temperature of 440° C. From soaker/reactor 38 is provided an upgraded hydrocarbon product and a by-product containing residue and/or coke as well as catalytic metal from the catalytic emulsion. This by-product mixture is fed to a heat exchanger 40 and then to a desalting unit 42 where catalytic metal salts are removed through gasification and/or desalinization and returned to catalyst preparation station 36, while a transportable synthetic crude oil product of the present process is provided typically having an improved API gravity, for example greater than or equal to 13°.

It should of course be appreciated that although FIG. 2 constitutes a schematic representation of a preferred embodiment of the process of the present invention, no limitation upon the scope of the present invention is intended.

Figure 3:
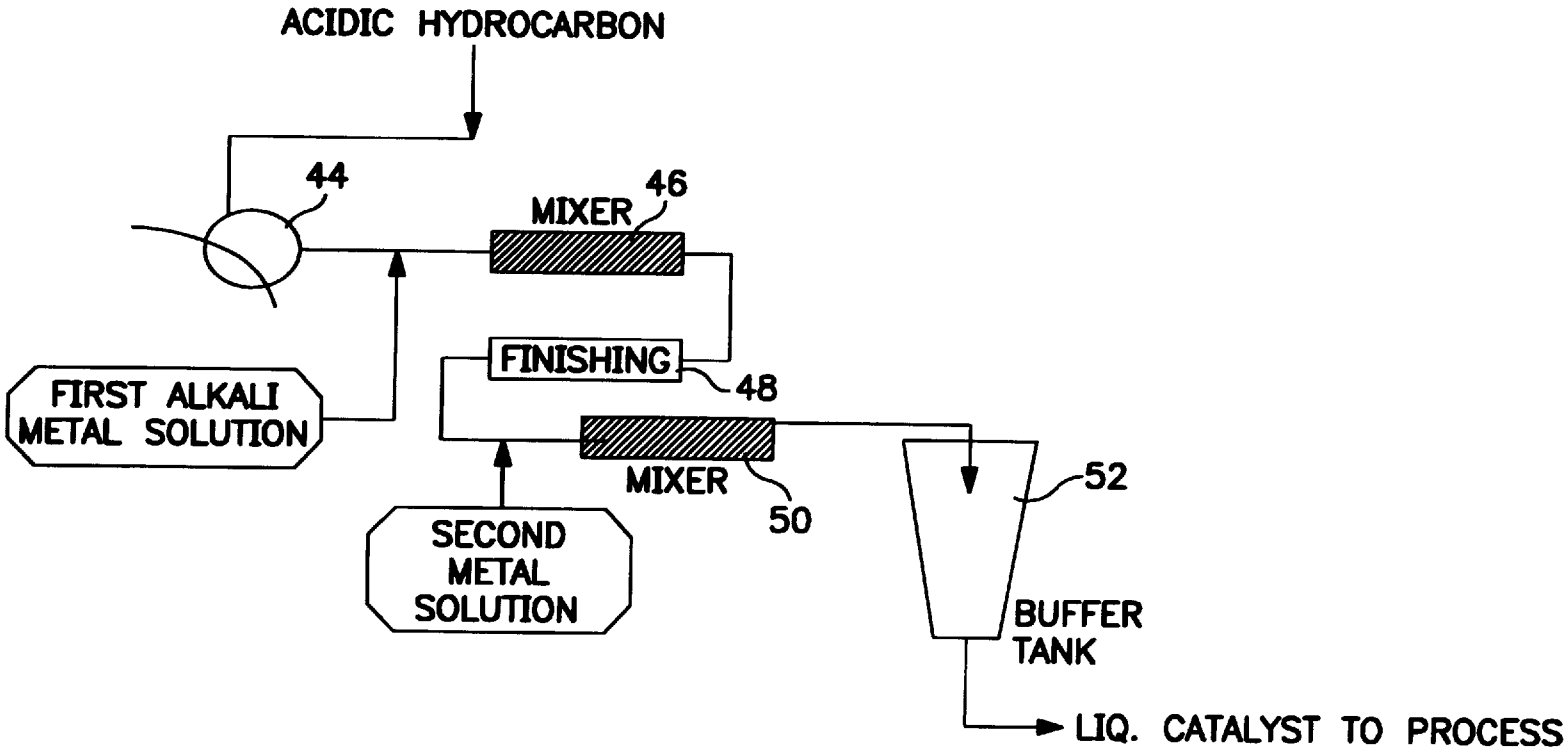
FIG. 3 is a schematic illustration of a process for preparation of a catalytic emulsion in accordance with the present invention.

Referring now to FIG. 3, a further schematic representation of a process for preparing a catalytic emulsion in accordance with the present invention is provided. FIG. 3 shows an inlet of an acidic hydrocarbon stream such as a naphthenic acid rich hydrocarbon stream which is fed to a heat exchanger 44, and then mixed with a saturated solution of alkali hydroxide in water. The naphthenic acid rich stream and saturated alkali solution are preferably mixed in suitable proportion that acidity of the hydrocarbon stream is at least partially neutralized, and substantially all alkali hydroxide in the saturated solution is reacted to form alkali naphthenic salt. This reaction is enhanced, and an emulsion may be formed, in a mixer 46 to which the hydrocarbon stream/alkali saturated solution mixture is fed. After this step, the mixture is passed from mixer 46 to a finishing station 48 for neutralization of any remaining acidity of the hydrocarbon stream, if needed. Following finishing station 48, a second saturated solution of the second catalytic metal, in this example a solution of nickel acetate in water, is mixed with the mixture from finishing station 48 and passed to an additional mixer 50 wherein sufficient mixing energy is imparted to provide the desired catalytic water-in-oil emulsion having the first alkali metal in the form of an alkali naphthenic salt located at the interface between water droplets and the continuous oil phase and also acting as a surfactant, and having the second metal, in this case nickel acetate, dissolved in the water droplets of the emulsion. The alkali naphthenic salt surfactant serves to provide the desired small droplet size which advantageously results in good dispersion of the catalytic metal, especially the second catalytic metal, through a feedstock to be upgraded according to the invention.

The emulsion may then be passed to a buffer tank 52, if needed, and subsequently to a treatment system for steam conversion of a heavy hydrocarbon feed in accordance with the present invention. The catalytic emulsion so formed preferably has a droplet size of less than or equal to about 10 microns, more preferably less than or equal to about 5 microns and ideally about 1 micron.

It should of course be realized that although FIG. 3 shows a schematic representation of a system for preparing a catalytic emulsion in accordance with the present invention, this schematic representation is not intended as a limitation upon the scope of the present invention.

The following examples demonstrate the advantages of the process and catalytic emulsion of the present invention.

EXAMPLE 1

This example illustrates the advantages of the process of the present invention as compared to a conventional viscosity reducing (visbreaking) process. The feedstock of Table 1 (acid number 25 mg KOH/g) was used to prepare a catalytic emulsion according to the invention using potassium and nickel. The catalyst emulsion was prepared by first mixing a stream of feedstock and a 40% wt. solution of KOH, and then mixing a solution of nickel acetate at a ratio (wt) of K:Ni of 4:1. The catalytic emulsion was mixed with the feedstock so as to provide 1000 ppm of potassium and 250 ppm nickel acetate with respect to the feedstock, and the reaction mixture was subjected to steam conversion conditions including a temperature of 430° C. and LHSV=$2h^{-1}$, 8% wt. steam based on feed (Process 1). The emulsion and feedstock were treated in a soaker having a volume of 1.2 liters. Feed flow was 2400 g/h, while catalytic emulsion flow was 113 g/h.

The same feedstock was subjected to visbreaking under the same conditions, without using a catalyst and using a small amount of steam (Process 2). The conversion and other process completion parameters are set forth in Table 2 below.

TABLE 2

| T:430° C., LHSV = 2 $h^{-1}$ | Process 1 | Process 2 |
|---|---|---|
| CONV., 500° C.+ (% wt) | 40 | 25 |
| ASPH. CONV. (% wt) | 12 | −32 |
| Visc., 350° C. (Cst) | 1269 | 9973 |
| V50 350° C. | 34 | 46.5 |
| API Grav. (350° C.) | 7.4 | 2.8 |
| AV50 (350° C.) | 5.5 | 4.8 |
| Fuel Gain (% wt) | 80 | 28.9 |

As shown, the results obtained using the process of the present invention (Process 1) provided enhanced results in conversion (40%) as compared to conventional visbreaking (25%) (Process 2).

Further, the final product of Process 1 according to the invention includes an upgraded hydrocarbon as well as a long and short residue which has been found according to the invention to contain most if not all of the catalytic metal of the catalyst emulsion. This catalytic metal can be recovered according to the invention through desalination or gasification for use in preparation of additional catalytic emulsion for subsequent processing according to the invention. In this case, the residue fraction product of Process 1 was desalted and potassium was recovered up to 94% (wt) of the original starting potassium.

EXAMPLE 2

In this example, the steam conversion process of the present invention was utilized under more severe steam conversion conditions using a residue feedstock having a composition as set forth in Table 3 below:

TABLE 3

| | | Feedstock | Product |
|---|---|---|---|
| Conv. 500° C.+ | (% wt) | — | 65.00 |
| API | | 5.50 | 13.00 |
| Sulfur | (% wt) | 3.50 | 2.86 |
| Carbon | (% wt) | 84.44 | 84.54 |
| Hydrogen | (% wt) | 10.19 | 10.80 |
| Nickel | (ppm) | 106.00 | 60.00 |
| Nitrogen | (% wt) | 0.50 | 0.40 |
| Vanadium | (ppm) | 467.00 | 100.00 |
| Asphaltene, | (% wt) | 12.37 | 8.00 |
| C. Conradson | (% wt) | 17.69 | 10.00 |
| Solids | (% wt) | 0.17 | 8.50 |
| Visc. 210° F. | (Cst) | 3805.67 | 344.90 |

| Distillation | % wt | API | % wt | API |
|---|---|---|---|---|
| IBP–200° C. | 0.00 | 0.00 | 6.00 | 50.00 |
| 200–350° C. | 0.00 | 0.00 | 19.00 | 27.00 |
| 350–500° C. | 17.00 | 18.50 | 36.00 | 12.00 |
| >500° C. | 83.00 | 3.00 | 29.00 | 2.50 |

The feedstock was treated with a catalytic emulsion as prepared in Example 1, in the same proportions as set forth above.

As shown, the process according to the present invention provided excellent conversion of the residue fraction 500° C.+, and provided a high yield of lighter hydrocarbon fractions as well. Also the coke production was substantially less than 9% as compared to the more than 30% coke which is typically obtained using conventional delayed coking procedures. This reduction in coke is particularly useful in reducing solids which must be transported or disposed of.

Further, the process of the present invention provided a by-product of carbonaceous solids that contained almost all of the catalyst metals. By gasification of the coke, 95% (wt) of the starting alkali metal (potassium) was recovered for use in preparing additional catalytic emulsion, and through simple dissolution with acetic acid, 110% of the transition metal (nickel) was recovered.

EXAMPLE 3

This example demonstrates the process of the present invention as compared to conventional visbreaking in a process for production of synthetic crude. A feedstock was provided having a composition as set forth below in Table 4.

TABLE 4

| | | |
|---|---|---|
| API | | 9.4 |
| Sulfur | (% wt) | 3.6 |

TABLE 4-continued

| | | |
|---|---|---|
| Carbon | (% wt) | 82.12 |
| Hydrogen | (% wt) | 10.75 |
| Nickel | (ppm) | 86.00 |
| Nitrogen | (% wt) | 0.53 |
| Vanadium | (ppm) | 403.00 |
| Ashphaltenes | (% wt) | 8.93 |
| C. Conradson | (% wt) | 12.66 |
| Ash | (% wt) | 0.09 |
| Viscosity | | |
| 104° F. | (cSt) | 14172.00 |
| 212° F. | (cSt) | 149.90 |

| Distillation | % wt | API |
|---|---|---|
| IBP–200° C. | 1.09 | 38.60 |
| 200–350° C. | 15.56 | 25.00 |
| 350–500° C. | 26.75 | 12.68 |
| >500° C. | 56.60 | 3.00 |

This feed was treated using a catalytic emulsion and steam conversion process according to the present invention wherein catalytic emulsion was prepared online using feedstock having an acidity number of 3.5 mg KOH/g. Catalytic emulsion sufficient to neutralize 1 mg KOH/g was mixed with the feed. The emulsion was prepared from a 40% wt. KOH solution at 6 g/h and a 14% wt. nickel acetate solution at 13.6 g/h. The flow of feed was 2400 g/h. The feedstock was also treated following a conventional visbreaking process at the same conditions. The results are set forth below in Table 5

TABLE 5

| | | Present invention | Visbreaking |
|---|---|---|---|
| Conv. 500° C.+ | (% wt) | 35.00 | 15.00 |
| API | | 14.80 | 11.90 |
| Sulfur | (% wt) | 2.96 | 3.12 |
| Carbon | (% wt) | 85.54 | 85.80 |
| Hydrogen | (% wt) | 10.90 | 10.54 |
| Nickel | (ppm) | 340.00 | 87.00 |
| Nitrogen | (% wt) | 0.40 | 0.49 |
| Vanadium | (ppm) | 409.00 | 411.00 |
| Ashphaltenes | (% wt) | 7.71 | 11.80 |
| C. Conradson | (% wt) | 10.30 | 15.10 |
| Viscosity 122° F. | (cSt) | 53.20 | 62.30 |

| Distillation | % wt | API | % wt | API |
|---|---|---|---|---|
| IBP–200° C. | 4.62 | 47.30 | 4.00 | 50.60 |
| 200–350° C. | 26.63 | 25.40 | 20.00 | 24.50 |
| 350–500° C. | 30.40 | 13.70 | 25.90 | 12.70 |
| >500° C. | 36.79 | 3.00 | 48.11 | 2.60 |

Yields Based on Feed.

As shown in Table 5 above, the process of the present invention provided better yield and properties of the syncrude produced as compared to visbreaking.

EXAMPLE 4

This example illustrates the process of the present invention carried out at more severe conditions (T=440° C., P=150 psig, space velocity (vol soaker/vol residue/hour)= 0.5 $h^{-1}$, steam partial pressure 130 psig) and compared to a conventional delayed coking process. The feedstock for this example was the same as set forth in Table 4 of Example 3 above. The same catalytic emulsion preparation of Example 3 was used. The feedstock flow was reduced to 600 g/h to provide a space velocity of 0.5 $h^{-1}$. The flows of KOH solution and nickel acetate solution were 1.5 g/h and 3.4 g/h respectively. The results of both processes are set forth below in Table 6.

TABLE 6

| | | Present invention | Delayed Coking |
|---|---|---|---|
| Conv. 500° C.+ | (% wt) | 65.00 | 68.00 |
| API | | 20.20 | 28.40 |
| Sulfur | (% wt) | 2.57 | 1.80 |
| Carbon | (% wt) | 85.00 | 86.50 |
| Hydrogen | (% wt) | 11.11 | 13.50 |
| Nickel | (ppm) | 10.00 | 0.00 |
| Nitrogen | (% wt) | 0.31 | 0.13 |
| Vanadium | (ppm) | 80.00 | 0.00 |
| Ashphaltenes | (% wt) | 6.20 | 0.00 |
| C. Conradson | (% wt) | 8.79 | 0.00 |
| Viscosity 122° F. | (cSt) | 46.40 | |

TABLE 6-continued

| Distillation | % wt | API | % wt | API |
|---|---|---|---|---|
| IBP–200° C. | 11.80 | 49.90 | 16.61 | 49.30 |
| 200–350° C. | 36.57 | 25.00 | 31.81 | 26.3 |
| 350–500° C. | 25.50 | 15.10 | 22.95 | 16.2 |
| >500° C. | 19.81 | 3.00 | 0.00 | 0.00 |
| Solids | 4.92 | | 20.40 | |

Yields Based on Feed.

From Table 6, several observations can be made. It is clear that the syncrude obtained from delayed coking has in principal better quality as compared to that provided according to the process of the present invention. However, the proportion of solids produced conventionally is much higher than that produced according to the present invention. Further, the process of the present invention produced an increased proportion of middle distillates, and the residue from this process can of course be further refined, even using delayed coking, if desired, to produce overall higher yields of lower boiling point fractions.

The reduced coke production of the process according to the present invention is advantageous for example when syncrude is produced in remote zones, where major investments in facilities for solid transportation would be needed to transport the coke and thereby avoid environmental impact in the remote area. Further, the coke produced according to the present invention can be completely burned using the heat released for other internal process needs while simultaneously recovering from resulting ash the catalytic metals as discussed above for re-use in additional catalytic emulsion preparation.

EXAMPLE 5

This example illustrates the effective conversion of hydrocarbon feed following the process of the present invention using catalytic emulsion having different combinations of catalytic metals. The conversions were carried out using the fraction 500° C.+ obtained from vacuum distillation of the crude of Table 4. The examples were carried out at a temperature of 440° C., pressure of 1 barg, and ratio of feed/steam of 7. A continuous operation was implemented with constant flow of feedstock (60 ml/h) and steam, for 4 hours per example. A stirred tank reactor was used having a volume of 100 ml. The results are set forth below in Table 7.

TABLE 7

| | | | | Distillates Distribution | | | | |
|---|---|---|---|---|---|---|---|---|
| catalyst | formulation* | % conv. 500° C.+ | gases % wt | IBP–220° C. % wt | 220–350° C. % wt | 350–500° C. % wt | 500° C.+ % wt | coke % wt |
| no cat. | — | 50 | 5 | 11 | 21 | 51 | 17 | 40 |
| Na—Ni | 1:1, 1800 ppm | 69 | 5 | 14 | 30 | 51 | 5 | 28 |
| Na—Ca | 1:2, 3000 ppm | 70 | 2 | 13 | 23 | 53 | 11 | 21.5 |
| K—Ni | 1:1, 1400 ppm | 65 | 3 | 11 | 22 | 50 | 17 | 22.2 |
| Na—Ca—Ni | 1:1:1, 2500 ppm | 74 | 5 | 10 | 21 | 46 | 23 | 5.2 |

*The atomic ratio of the metals used, are presented in this column along with the concentration of catalyst in ppm based on feed.

As shown, each of the combinations of catalytic metals in the catalytic emulsion of the present invention provide excellent conversion of the feedstock and advantageously reduced amounts of coke.

Thus provided are a process for steam conversion of a heavy hydrocarbon feedstock, a catalytic emulsion for use in the steam conversion, and a process for preparing the catalytic emulsion so as to attain the objects and advantages of the present invention.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. A process for conversion of a hydrocarbon feedstock in the presence of a catalyst, comprising the steps of:

(a) providing a catalytic emulsion comprising a water in oil emulsion containing a first alkali metal and a second metal selected from the group consisting of Group VIII non-noble metals, alkaline earth metals and mixtures thereof;

(b) mixing the catalytic emulsion with a hydrocarbon feedstock to provide a reaction mixture; and (c) subjecting the reaction mixture to steam conversion conditions so as to provide an upgraded hydrocarbon product.

2. A process according to claim 1, wherein said steam conversion conditions include a temperature between about 360° C. to about 520° C., a pressure between about 5 psi to about 600 psi, a liquid hourly space velocity between about 0.001 $h^{-1}$ to about 3.5 $h^{-1}$ and steam in an amount between about 1% to about 15% wt based on said feedstock.

3. A process according to claim 2, wherein said steam conversion conditions include a temperature between about 410° C. to about 470° C., a pressure between about 10 psi to about 300 psi and steam in an amount between about 3% to about 12% wt based on said feedstock.

4. A process according to claim 1, wherein said steam conversion conditions include a pressure of less than or equal to about 600 psi.

5. A process according to claim 1, wherein said steam conversion conditions include a pressure of between about 50 psi to about 600 psi.

6. A process according to claim 1, wherein said steam conversion conditions include a pressure of less than or equal to about 300 psi.

7. A process according to claim 1, wherein said steam conversion conditions include a pressure between about 100 psi to about 300 psi.

8. A process according to claim 1, wherein step (c) results in substantially homogeneous dispersion of said first alkali metal and said second metal in said feedstock whereby steam conversion is facilitated.

9. A process according to claim 1, wherein step (c) results in vaporizing substantially all water of said emulsion so as to provide at least a portion of steam requirements for said steam conversion.

10. A process according to claim 1, wherein said feedstock is an extra heavy crude having a first API gravity and a first viscosity, and wherein said upgraded hydrocarbon product is a synthetic crude having a second API gravity greater than said first API gravity and a second viscosity less than said first viscosity.

11. A process according to claim 1, wherein said feedstock is an extra heavy crude having an API gravity of less than or equal to about 10°, and wherein said upgraded hydrocarbon product is a synthetic crude having an API gravity of greater than or equal to about 13°.

12. A process according to claim 11, further comprising the steps of mixing said extra heavy crude with a diluent so as to provide a mixture having an API gravity greater than said extra heavy crude, passing said mixture to a distiller for separating said diluent and a residue, and mixing said residue with said catalytic emulsion to provide said reaction mixture.

13. A process according to claim 1, wherein step (c) provides said upgraded hydrocarbon product and a by-product containing said first alkali metal and said second metal from said catalytic emulsion, and further comprising the step or recovering said first alkali metal and said second metal from said by-product to provide recovered metals, and using said recovered metal to provide additional catalytic emulsion for step (a).

14. A process according to claim 1, wherein said catalytic emulsion has an average droplet size of less than or equal to about 10 microns.

15. A process according to claim 1, wherein said catalytic emulsion has an average droplet size of less than or equal to about 5 microns.

16. A process according to claim 1, wherein said first alkali metal is present in said catalytic emulsion as an alkali organic salt in an interface between said water phase and said oil phase, and wherein said second metal is present in said catalytic emulsion in solution in said water phase.

17. A process according to claim 16, wherein said alkali organic salt is an alkali naphthenic salt.

18. A process according to claim 1, wherein said first alkali metal is selected from the group consisting of potassium, sodium and mixtures thereof.

19. A process according to claim 1, wherein said second metal is a Group VIII non-noble metal selected from the group consisting of nickel, cobalt and mixtures thereof.

20. A process according to claim 1, wherein said second metal is an alkaline earth metal selected from the group consisting of calcium, magnesium and mixtures thereof.

21. A process according to claim 1, wherein said second metal comprises a Group VIII non-noble metal selected from the group consisting of nickel, cobalt and mixtures thereof and an alkaline earth metal selected from the group consisting of calcium, magnesium and mixtures thereof.

22. A process according to claim 1, wherein said first alkali metal comprises sodium and said second metal comprises calcium and nickel.

23. A process according to claim 1, wherein said catalytic emulsion contains said first alkali metal and said second metal in a ratio by weight of between about 0.5:1 to about 20:1.

24. A process according to claim 1, wherein said catalytic emulsion contains said first alkali metal and said second metal in a ratio by weight of between about 1:1 to about 10:1.

25. A process according to claim 1, wherein said catalytic emulsion contains said first alkali metal at a concentration of at least about 10,000 ppm based upon weight of said catalytic emulsion.

26. A process according to claim 1, wherein said catalytic emulsion contains said first alkali metal sufficient to provide said reaction mixture with a concentration of said first alkali metal of at least about 400 ppm based upon weight of said reaction mixture.

27. A process according to claim 1, wherein said catalytic emulsion contains said first alkali metal sufficient to provide said reaction mixture with a concentration of said first alkali metal of at least about 800 ppm based upon weight of said reaction mixture.

28. A process according to claim 1, wherein said catalytic emulsion has a ratio of water to oil by volume of between about 0.1 to about 0.4.

29. A process according to claim 1, wherein said catalytic emulsion has a ratio of water to oil by volume of between about 0.15 to about 0.3.

30. A process according to claim 1, wherein step (a) comprises the steps of:

providing an acidic hydrocarbon stream having an acid number of at least about 0.4 mg KOH/g of hydrocarbon;

providing a first solution of said first alkali metal in water;

mixing the acidic hydrocarbon stream and the first solution so as to at least partially neutralize said hydrocarbon stream and form a substantially homogeneous mixture wherein said alkali metal reacts with said hydrocarbon stream to form an alkali organic salt;

providing a second solution of said second metal in water; and mixing the substantially homogeneous mixture and the second solution to provide said catalytic emulsion.

31. A process according to claim 30, wherein said acidic hydrocarbon stream has an acid number of between about 0.4 mg KOH/g to about 300 mg KOH/g.

32. A process according to claim 30, wherein said acidic hydrocarbon stream comprises naphthenic acid.

33. A process according to claim 30, wherein said step of providing said first solution comprises providing a saturated solution of said first alkali metal in water wherein said saturated solution is within about 5% of a saturation point of the solution at ambient temperature.

34. A process according to claim 30, wherein said step of providing said second solution comprises providing a saturated solution of said second metal in water wherein said saturated solution is within about 5% of a saturation point of said saturated solution at ambient temperature.

35. A process according to claim 30, wherein said acidic hydrocarbon stream is obtained from said hydrocarbon feedstock.

36. A catalytic emulsion for conversion of a hydrocarbon feedstock, comprising:

a water in oil emulsion containing a first alkali metal and a second metal selected from the group consisting of Group VIII non-noble metals, alkaline earth metals and mixtures thereof.

37. A catalytic emulsion according to claim 36, wherein said catalytic emulsion has an average droplet size of less than or equal to about 10 microns.

38. A catalytic emulsion according to claim 36, wherein said catalytic emulsion has an average droplet size of less than or equal to about 5 microns.

39. A catalytic emulsion according to claim 36, wherein said first alkali metal is selected from the group consisting of potassium, sodium and mixtures thereof.

40. A catalytic emulsion according to claim 36, wherein said first alkali metal is present in said catalytic emulsion as an alkali organic salt in an interface between said water phase and said oil phase, and wherein said second metal is present in said catalytic emulsion in solution in said water phase.

41. A catalytic emulsion according to claim 36, wherein said first alkali metal is selected from the group consisting of potassium, sodium and mixtures thereof.

42. A catalytic emulsion according to claim 36, wherein said second metal is a Group VIII non-noble metal selected from the group consisting of nickel, cobalt and mixtures thereof.

43. A catalytic emulsion according to claim 36, wherein said second metal is an alkaline earth metal selected from the group consisting of calcium, magnesium and mixtures thereof.

44. A catalytic emulsion according to claim 36, wherein said second metal comprises a Group VIII non-noble metal selected from the group consisting of nickel, cobalt and mixtures thereof and an alkaline earth metal selected from the group consisting of calcium, magnesium and mixtures thereof.

45. A catalytic emulsion according to claim 36, wherein said first alkali metal comprises sodium and said second metal comprises calcium and nickel.

46. A catalytic emulsion according to claim 36, wherein said catalytic emulsion contains said first alkali metal and said second metal in a ratio by weight of between about 0.5:1 to about 20:1.

47. A catalytic emulsion according to claim 36, wherein said catalytic emulsion contains said first alkali metal and said second metal in a ratio by weight of between about 1:1 to about 10:1.

48. A catalytic emulsion according to claim 36, wherein said catalytic emulsion contains said first alkali metal at a concentration of at least about 10000 ppm based upon weight of said catalytic emulsion.

49. A catalytic emulsion according to claim 36, wherein said catalytic emulsion has a ratio of water to oil by volume of between about 0.1 to about 0.4.

50. A catalytic emulsion according to claim 36, wherein said catalytic emulsion has a ratio of water to oil by volume of between about 0.15 to about 0.3.

51. A process for preparation of a catalytic emulsion, comprising the steps of:

providing an acidic hydrocarbon stream having an acid number of at least about 0.4 mg KOH/g of hydrocarbon;

providing a first solution of a first alkali metal in water;

mixing the acidic hydrocarbon stream and the first solution so as to at least partially neutralize said hydrocarbon stream and form a substantially homogeneous mixture wherein said alkali metal reacts with said hydrocarbon stream to form an alkali organic salt;

providing a second solution of a second metal selected from the group consisting of Group VIII non-noble metals, alkaline earth metals, and mixtures thereof, in water; and mixing the substantially homogeneous mixture and the second solution to provide said catalytic emulsion.

52. A process according to claim 51, wherein said acidic hydrocarbon stream has an acid number of between about 0.4 mg KOH/g to about 300 mg KOH/g.

53. A process according to claim 51, wherein said acidic hydrocarbon stream comprises naphthenic acid.

54. A process according to claim 51, wherein said step of providing said first solution comprises providing a saturated solution of said first alkali metal in water wherein said saturated solution is within about 5% of a saturation point of the solution at ambient temperature.

55. A process according to claim 51, wherein said step of providing said second solution comprises providing a saturated solution of said second metal in water wherein said saturated solution is within about 5% of a saturation point of said saturated solution at ambient temperature.

56. A process according to claim 51, wherein said acidic hydrocarbon stream has an acidity and said first solution has a content of alkali hydroxide, and further comprising mixing sufficient amounts of said first solution and said hydrocarbon stream such that substantially all of said alkali hydroxide reacts with said hydrocarbon stream to provide an alkali organic salt and at least partially neutralize said acidity.

57. A process according to claim 51, wherein said hydrocarbon stream contains naphthenic acid whereby said alkali metal reacts with said hydrocarbon stream to form an alkali naphthenic salt.

58. A process according to claim 51, wherein said substantially homogeneous mixture contains substantially all of said first alkali metal as said alkali organic salt.

59. A process according to claim 51, wherein said second solution contains said second metal in the form of a second metal acetate.

* * * * *